United States Patent [19]

Wasserman et al.

[11] 4,055,925

[45] Nov. 1, 1977

[54] EXPANSION JOINT AND FLASHING CONSTRUCTION

[75] Inventors: Max Wasserman, Chestnut Hill; Martin E. Gorman, Jr., Belmont, both of Mass.

[73] Assignee: Sandell Mfg. Co., Inc., Cambridge, Mass.

[21] Appl. No.: 701,555

[22] Filed: July 1, 1976

[51] Int. Cl.[2] ..... E04D 3/38; E04B 1/68

[52] U.S. Cl. ..... 52/403; 52/573; 52/395; 52/472; 428/256; 428/468

[58] Field of Search ..... 52/459, 395, 573, 403, 52/396, 233, 664, 472; 404/69; 428/256, 291, 468

[56] References Cited

U.S. PATENT DOCUMENTS

| | | | |
|---|---|---|---|
| 958,450 | 5/1910 | Wardell | 428/256 X |
| 2,472,100 | 6/1949 | Fair, Jr. | 428/468 X |
| 3,375,621 | 4/1968 | Curtis et al. | 52/403 X |
| 3,455,077 | 7/1969 | Long | 52/459 |
| 3,566,553 | 3/1971 | Kellman | 52/459 |
| 3,581,450 | 6/1971 | Patry | 52/403 |
| 3,643,388 | 2/1972 | Parr et al. | 52/573 |
| 3,694,976 | 10/1972 | Warshaw | 52/573 X |
| 3,770,559 | 11/1973 | Jackson | 428/256 X |
| 3,957,091 | 5/1976 | Buyssens et al. | 428/256 X |
| 3,968,296 | 7/1976 | Nopper et al. | 428/256 |

FOREIGN PATENT DOCUMENTS

| | | | |
|---|---|---|---|
| 920,383 | 3/1963 | United Kingdom | 52/395 |

OTHER PUBLICATIONS 2922,442, Jan. 1970, Webber.
3721,578, Mar. 1973, Bennett et al.

*Primary Examiner*—Price C. Faw, Jr.
*Assistant Examiner*—Robert C. Farber
*Attorney, Agent, or Firm*—Wolf, Greenfield & Sacks

[57] ABSTRACT

An expandable covering includes an insulating cushion dimensioned to bridge a gap between two structural members commonly referred to as an expansion joint. In a preferred form the construction comprises a composite neoprene coated fabric strip of a first width which is typically about 18 inches, a narrower expansion bellows and mailing strip constructed of an asphalt coated woven wire cloth and the insulating cushion. The coated woven wire cloth is heat sealed to the fabric side of the composite strip. In a different embodiment the neoprene coated fabric strip is replaced by an asphalt saturated cloth. In still a further embodiment a neoprene strip is glued directly to an asphalt-free center area of an asphalt impregnated or coated woven wire cloth.

7 Claims, 4 Drawing Figures

EXPANSION JOINT AND FLASHING CONSTRUCTION

BACKGROUND OF THE INVENTION

The present invention relates in general to an expansion joint and flashing construction and is concerned more particularly with an improved expandable covering that provides an excellent seal between spaced structural members even as expansion occurs between these structural members. Various types of expansion joint constructions are shown in the prior art. See, for example, U.S. Pat. No. 3,694,976. One of the most troublesome problems appears to be in adequately sealing the expandable cover to the building structure.

Accordingly, one object of the present invention is to provide an improved expansion joint covering for positively sealing between two structural members that expand relative to each other.

Another object of the present invention is to provide an expansion joint and flashing construction that is relatively easy to manufacture and can be constructed inexpensively.

A further object of the present invention is to provide an expansion joint cover that seals quite permanently providing an expansion joint having a long useable life. The cover can be bonded directly to the roof with common asphalt or pitch.

Still another object of this invention is to provide an expansion joint cover that comprises a dual-purpose member functioning as both an expansion bellows and a nailing strip.

SUMMARY OF THE INVENTION

To accomplish the foregoing and other objects of the invention there is provided an expansion joint construction or covering that comprises an insulating strip means for bridging a gap between two structural members which are to be joined by the expansion joint construction. The construction also comprises an asphalt impregnated or coated woven wire cloth having a width greater than the width of the insulating strip means and being heat-sealed on one side to the insulating strip means. A composite neoprene coated fabric strip means having a width greater than the width of the asphalt impregnated woven wire cloth is heat-sealed to the other side of the woven wire cloth. The insulating strip means, asphalt impregnated woven wire cloth, and the composite neoprene coated fabric strip means are all preferably symmetrically arranged.

In an alternative embodiment of the invention the neoprene coated fabric strip may be replaced by an asphalt or pitch coated cloth. In still a further embodiment in accordance with the invention the asphalt coated woven wire cloth has a central strip that is asphalt-free. In this embodiment a neoprene strip is glued directly to the asphalt-free strip on the woven strip cloth.

BRIEF DESCRIPTION OF THE DRAWINGS

Numerous other objects, features and advantages of the invention will now become apparent upon a reading of the following detailed description taken in conjunction with the accompanying drawings, in which.

DETAILED DESCRIPTION

Figure 1:
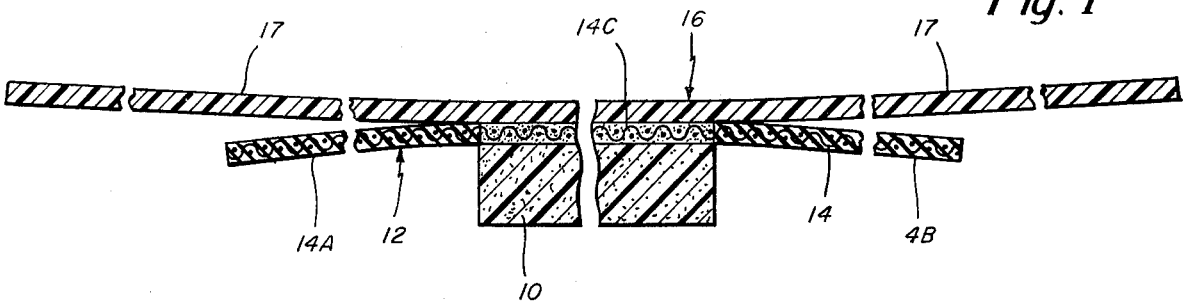
FIG. 1 is a cross-sectional view through one expandable covering in accordance with this invention.
Figure 3:
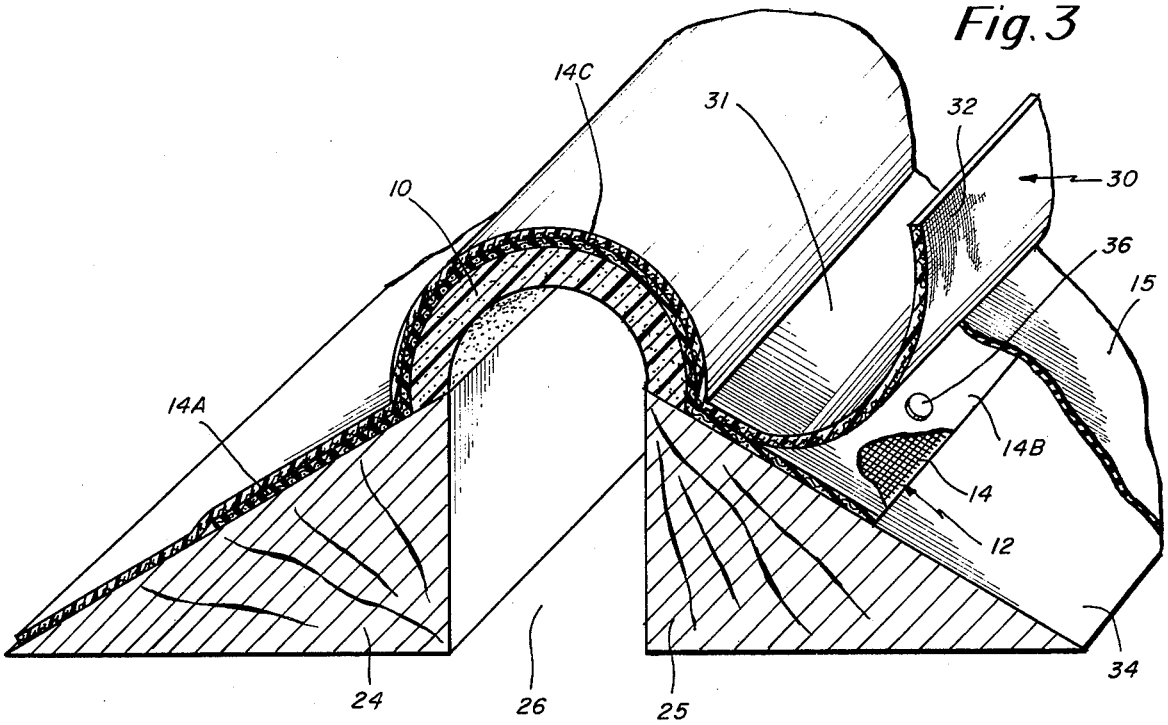
FIG. 3 is a cross-sectional perspective view through a preferred embodiment of the expandable cover of this invention.
Figure 4:
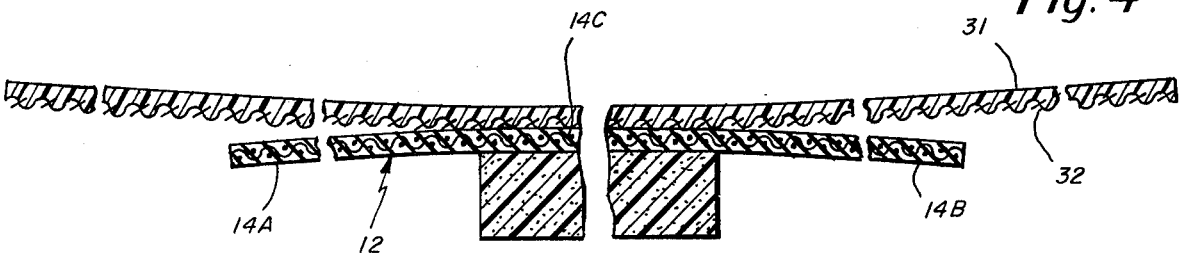
FIG. 4 is a cross-sectional view through the preferred embodiment of FIG. 3.

FIG. 1 shows one embodiment in accordance with this invention which comprises a foam urethane insulation material 10 which is for bridging the expansion joint formed by a gap between two structural members as shown in FIG. 3, for example. Next to the material 10 there is a composite strip 12 which is comprised of a woven wire cloth 14 impregnated or coated on both sides with asphalt in areas 14A and 14B. The central area 14C is free of the impregnated asphalt. A neoprene strip 16 overlies the strip 12. The area 14C is coextensive with the urethane material 10 and the neoprene is glued along the area coextensive with area 14C leaving unglued the end flaps 17. The material 10 may have a width of, for example, 6 inches while the strip 14 may have a width of 12 inches and the neoprene 16 a width of 18 inches.

The embodiment shown in FIG. 1 may be constructed by first impregnating or coating the areas 14A and 14B of the woven wire cloth with an asphalt. The material 10 and the central area of the neoprene 16 may then be bonded such as by gluing to the central area 14C of the strip 14. When the expandable cover is to be used, the flaps 17 are lifted and the strip 12 is nailed on one side of the expansion joint such as along the area 14A in a longitudinal direction. The structure then may be at least partially folded with the other area 14B functioning as a nailing strip on the other side of the expansion joint. The central area 14C of the expansion bellows/-nailing strip may be disposed in the manner shown in FIG. 3.

The expandable covering shown in FIG. 1 may be formed into a roll or may be sold in batts. The cloth may be impregnated with different bituminous products such as coal tar, asphalt or pitch.

After the areas 14A and 14B have been nailed on opposite sides of the expansion joint then these areas may be mopped with an asphalt or coal tar pitch to essentially seal the strip 12 to the roof or other structural member forming the expansion joint. The flaps 17 are then layered over the mopped asphalt or pitch.

Figure 2:
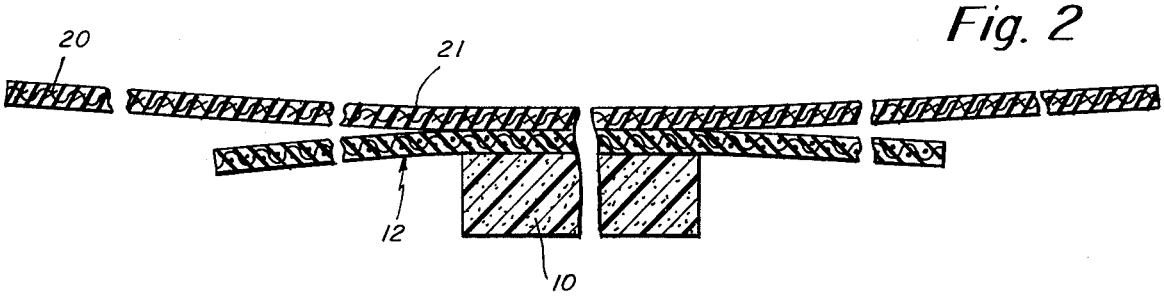
FIG. 2 is a cross-sectional view through still another embodiment in accordance with the invention.

The embodiment shown in FIG. 1 functions satisfactorily. However, there may be a tendency for the neoprene to not sufficiently stick to the mopped asphalt thus requiring additional cementing and waterproofing of neoprene flaps 17. Thus, FIG. 2 shows an alternate embodiment. In FIG. 2 like reference characters will be used to designate like parts. Thus, in FIG. 2 there is shown the insulating material 10 and the dual purpose strip 12 which is constructed of a woven wire cloth totally impregnated or at least coated with asphalt on both sides. In FIG. 2 there is also provided a cloth material 20 coated on both sides with an asphalt 21. In this embodiment the foam insulation material 10, the strip 12 and the asphalt coated cloth are all sealed together by a heat sealing technique. The width dimensions of the embodiment shown in FIG. 2 may be substantially the same as the dimensions discussed with regard to FIG. 1.

Although the embodiment of FIG. 2 provides a satisfactory structure, the preferred embodiment is shown in FIG. 3. This embodiment is preferred because there is a good sealing of the strip 12 with the mopped asphalt and additionally the neoprene provided a durable outer surface.

FIG. 3 is a perspective cross-sectional view showing the expandable covering of the present invention in a preferred embodiment covering an expansion joint defined by the structural members 24 and 25 which define a gap 26 therebetween. This embodiment comprises a foam urethane insulating material 10 which is bonded to an expansion bellows/nailing strip 12 formed of a woven wire cloth 14 that is impregnated or coated with a rubberized asphalt coating on both sides. In FIG. 3 this asphalt coating 15 is shown partially cut away to expose the woven wire cloth or mesh screen 14. The mesh may be conventional mesh having 1/16 inch mesh openings. A composite neoprene coated fabric strip 30 is bonded to the central area 14C of the strip 12. The cover 30 is preferably constructed of a 40 mil neoprene coated fabric material with an integral fabric substrate which is a readily commercially available material. The cover 30 may also be constructed using, in place of neoprene, a butyl, eborn or hypacon material. This material provides an outer neoprene layer 31 which provides an outer cover having strength and the ability to withstand severe weather changes and is also resistant to different types of solvents. The inner fabric layer 32 provides a surface that will adhere quite easily to the mopped on asphalt or pitch which is mopped over the surface 34 and also over the ends 14A and 14B of the strip 12. FIG. 3 shows one of the nails 36 used to attach the combination expansion bellows and nailing strip 12 to one of the structural members 25.

The strip 12 shown in FIG. 3 is actually a dual purpose component which can be easily shaped to any contour such as the one shown in FIG. 3. The wire mesh 14 provides an extremely high strength elastic bellows which also functions as a self-sealing nailing strip along the areas 14A and 14B, and conforms to virtually any irregularity without special forming or the need of special tools. The strip 12 is always tight to the weather regardless of temperature or expansion stresses. The strip 12 has the characteristic of multiple direction movement and there are no rigid metal layers used which require pre-forming and offer resistance to longitudinal expansion stresses. A heat sealing technique is used for permanently bonding the center area 14C of the strip 12 to the cover 30. Alternatively other bonding techniques may be used.

With the preferred structure shown in FIG. 3 there is easy multi-directional movement of the expandable covering without the resistance offered by solid metal nailing flanges such as shown in the prior U.S. Pat. No. 3,694,976. Also, there is no need for the traditional "stripped in" or adhesive fastened coverings that are used in the prior art and therefore with the structure of this invention leaks caused by the popping of nails and the lifting of stripped felts is eliminated.

The composite strip 30 has two advantages. Because of the fabric backing 32, the strip 30 can be mopped directly to the roofing material with either hot asphalt or pitch. A single layer of neoprene must be "stripped in" or laid between two courses of felt which is more time-consuming procedure with still uncertain results. Secondly, the exposed neoprene provides a durable outer surface.

What is claimed is:

1. Expansion joint construction for bridging and insulating a gap between two structural members comprising;

an insulating strip means, a bituminous coated woven wire cloth means affixed on one side to and having flexible marginal portions extending beyond edges of said insulating strip means, and a cover means having a width greater than the width of said bituminous coated woven wire cloth means and having a center area affixed on the other side of said woven wire cloth means with marginal portions of said cover means extending beyond and free of said marginal portions of said wire cloth means, said cover means comprising a rubbery layer having a durable exposed outer surface and an integral fabric backing having an exposed inner surface along said marginal portions, and adhesive means affixing the other side of said bituminous coated woven wire cloth means to said fabric backing.

2. A construction as set forth in claim 1 wherein said woven wire cloth means comprises a screen mesh having screen openings on the order of 1/16 inch.

3. A construction as set forth in claim 2 wherein said insulating strip means comprises a urethane foam material heat sealed to the one side of the woven wire cloth means.

4. A construction as set forth in claim 1 wherein said rubbery layer comprises a neoprene layer.

5. A construction as set forth in claim 1 wherein said cloth means has coated or impregnated ends with a non-impregnated inner strip area.

6. Expansion joint construction comprising;

bituminous coated woven wire cloth means, a cover means having a width greater than the width of the bituminous coated woven wire cloth means and having a center area on one side of said woven wire cloth means with marginal portions of said cover means extending beyond and free of marginal portions of said wire cloth means, said cover means comprising a rubbery layer having a durable exposed outer surface and an integral fabric backing having an exposed inner surface along said marginal portions, and adhesive means affixing the other side of said bituminous coated woven wire cloth means to said fabric backing.

7. Expansion joint construction as set forth in claim 6 including insulating strip means secured to said cloth means opposite to the center area of the fabric backing.

* * * * *